US008013800B2

(12) United States Patent
Zheng et al.

(10) Patent No.: US 8,013,800 B2
(45) Date of Patent: Sep. 6, 2011

(54) MULTIBAND CONFORMED FOLDED DIPOLE ANTENNA

(75) Inventors: Tianji Zheng, Coral Springs, FL (US); Julio Castaneda, Coral Springs, FL (US)

(73) Assignee: Motorola Mobility, Inc., Libertyville, IL (US)

( * ) Notice: Subject to any disclaimer, the term of this patent is extended or adjusted under 35 U.S.C. 154(b) by 308 days.

(21) Appl. No.: 12/465,460

(22) Filed: May 13, 2009

(65) Prior Publication Data

US 2010/0289712 A1 Nov. 18, 2010

(51) Int. Cl.
*H01Q 9/26* (2006.01)

(52) U.S. Cl. ..... 343/803; 343/702; 343/770

(58) Field of Classification Search ..... 343/702, 343/803, 770, 741, 846, 767
See application file for complete search history.

(56) References Cited

U.S. PATENT DOCUMENTS

| | | | | |
|---|---|---|---|---|
| 6,697,025 | B2 * | 2/2004 | Koyanagi et al. | 343/741 |
| 6,762,723 | B2 | 7/2004 | Nallo et al. | |
| 7,176,838 | B1 | 2/2007 | Kinezos | |
| 7,375,689 | B2 * | 5/2008 | Chen et al. | 343/702 |
| 7,605,764 | B2 * | 10/2009 | Ishimiya | 343/702 |
| 2007/0040747 | A1 | 2/2007 | Kinezos | |
| 2007/0085747 | A1 | 4/2007 | DiNallo et al. | |

FOREIGN PATENT DOCUMENTS

| | | |
|---|---|---|
| JP | 2007-142799 | 6/2007 |
| JP | 2008-042510 | 2/2008 |

* cited by examiner

*Primary Examiner* — Tan Ho
(74) *Attorney, Agent, or Firm* — Pablo Meles

(57) ABSTRACT

A multiband comformed-slotted-folded dipole antenna (200) having a unitary conformed shape conductor conforming to an internal communication device configuration (400). The antenna can include a folded dipole (203, 205, 209, 206, 204) forming a part of the unitary conformed shape and having a first portion (212 or 213) forming at least one slot in a slotted plane (220) and a second portion (210 or 211) forming at least one slot in a second plane (230) substantially perpendicular to the slotted plane. The at least one slot in the second plane controls high band antenna resonance and a length (209) of a metal portion in the slotted plane controls lower band resonance. Additional embodiments are disclosed.

20 Claims, 2 Drawing Sheets

400

MULTIBAND CONFORMED FOLDED DIPOLE ANTENNA

FIELD OF THE DISCLOSURE

This invention relates generally to antennas, and more particularly to a multiband antenna operating on several distinct bands.

BACKGROUND

As wireless devices become exceedingly slimmer and greater demands are made for antennas operating on a diverse number of frequency bands, common antennas such as a Planar Inverted "F" Antenna (PIFA) design becomes impractical for multiband use in such slim devices due to its inherent height requirements. Antenna configurations typically used for certain bands can easily interfere or couple with other antenna configurations used for other bands. Thus, designing antennas for operation across a number of diverse bands each band having a sufficient bandwidth of operation becomes a feat in artistry as well as utility, particularly when such arrangements must meet the volume requirements of today's smaller communication devices.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate the embodiments and explain various principles and advantages, in accordance with the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION

Figure 1:
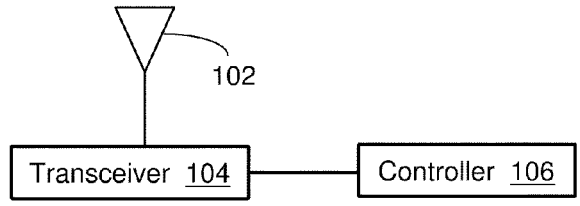
FIG. 1 depicts an embodiment of a communication device in accordance with the present disclosure.

FIG. 1 depicts an exemplary embodiment of a communication device 100. The communication device 100 comprises an antenna 102, coupled to a communication circuit embodied as a transceiver 104, and a controller 106. The transceiver 104 utilizes technology for exchanging radio signals with a radio tower or base station of a wireless communication system according to common modulation and demodulation techniques. Such techniques can include, but is not limited to GSM, TDMA, CDMA, UMTS, WiMAX, WLAN among others. The controller 106 utilizes computing technology such as a microprocessor and/or a digital signal processor with associated storage technology (such as RAM, ROM, DRAM, or Flash) for processing signals exchanged with the transceiver 104 and for controlling general operations of the communication device 100.

One embodiment of the present disclosure can entail a multiband comformed-slotted-folded dipole antenna having a unitary conformed shape conductor conforming to an internal communication device configuration, a folded dipole forming a part of the unitary conformed shape and having a first portion forming at least one slot in a slotted plane and a second portion forming at least one slot in a second plane substantially perpendicular to the slotted plane. The antenna can have at least one slot in the second plane controls high band antenna resonance and a length of a metal portion in the slotted plane controls lower band resonance. Note that the unitary conformed shape conductor is a single or contiguous conductor shaped to conform to a particular structure that can include one or more elements. For example, the unitary conformed shape conductor can conform to the shape of a circuit board and a speaker on the circuit board. The unitary conformed shape conductor can also conform to the circuit board itself or with other components as desired.

Another embodiment of the present disclosure can entail an antenna having a conformed slotted dipole antenna element having first antenna elements in a slotted plane and second antenna elements in a second plane, wherein the slotted plane is substantially orthogonal to the second plane, a first slot and a second slot in the second plane that controls a high band resonance when the slots are tuned, and a conductive line in the slotted plane having a length that controls a low band resonance.

Yet another embodiment of the present disclosure can entail an antenna having a substantially T-shaped slot in a slotted plane forming a low band controlling line portion coplanar and above the T-shaped slot and a high band controlling line portion coplanar and below a cross bar of the T-shaped slot, and a conductive line that is non-coplanar with the slotted plane and forms a slot having a gap between the slotted plane and the conductive line, wherein the gap further controls a high band resonance of the antenna.

Yet another embodiment of the present disclosure can entail a communication device comprising an antenna, a communication circuit coupled to the antenna, and a controller programmed to cause the communication circuit to process signals associated with a wireless communication system.

Antenna design for mobile devices (such as cell phones and PDAs) are facing additional challenges due to devices getting smaller and packed with electronic parts having more features. Therefore the volume for antennas is limited but requirements for antenna performance still remain reasonable high. Furthermore, technologies or new functions require multi-band operations of devices. To deal with these requirements and limitations, antenna engineers have come up with a lot of innovative designs such as (folded J antenna) FJA, (folded inverted conformed antenna) FICA, and (folded dipole antenna) FDA. Unfortunately, some of drawbacks or limitations exist when these antennas are applied to mobile devices.

In current implementations, an FJA requires at least 13 mm of space away from any grounded plane (such as a printed circuit board (PCB)). Sometimes there is difficulty in tuning antenna bands when interaction exists between two arms (in the cases that two arms are overlapped with certain separation).

FICA and FDA are not sensitive to a grounded plane and can provide some level of immunity to the human body (torso, head, or hand) due to the design of the grounded end. Nonetheless, it is very hard for a FICA design to be tuned for different bands because the bands share the same antenna elements. Every tuning for one band will affect other bands hence the tuning process is time-consuming due to the lack of independence of the antenna elements.

For FDAs (simple loop-like), besides the main resonance (2/λ or 4/λ resonance), other desired resonant bands are generally difficult to obtain, or if they are tuned, it is difficult to tune those bands without significantly impacting the main resonance (same issue discussed above with respect to a FICA design).

To mitigate or overcome the drawbacks described above, a new antenna was designed for a mobile device with multi-band operations. The design is a conformed, slotted, and folded antenna. In the design, beside a dipole structure for low band 800 MHz and 900 MHz, a special slot technique is applied to create any desired resonance such as GPS, 1800/900 band, or 2.4/2.5 GHz, and so on which can be independently tuned by bands that correspond to particular structures in the new design or designs. It is a good technology-combined design. In its structure and concept, the design can be referred to as a Conformed-Slotted-Folded Dipole (CSFD).

The CSFD antenna can create a desired resonance easily and the tuning for different bands is very simple. The grounded end of the antenna provides itself with the advantage of being less sensitive to a human body as in FICA and FDA designs.

Figure 2:
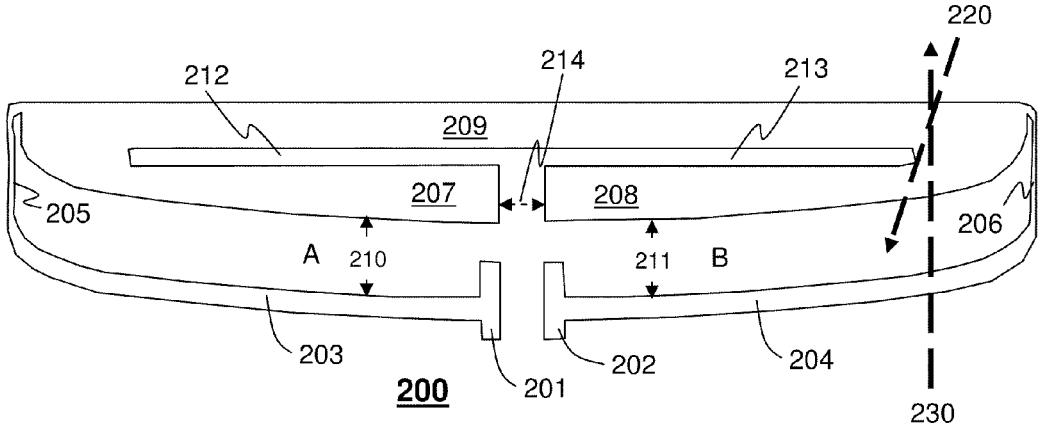
FIG. 2 depicts a top perspective view of a antenna configuration in accordance with the present disclosure.
Figure 3:
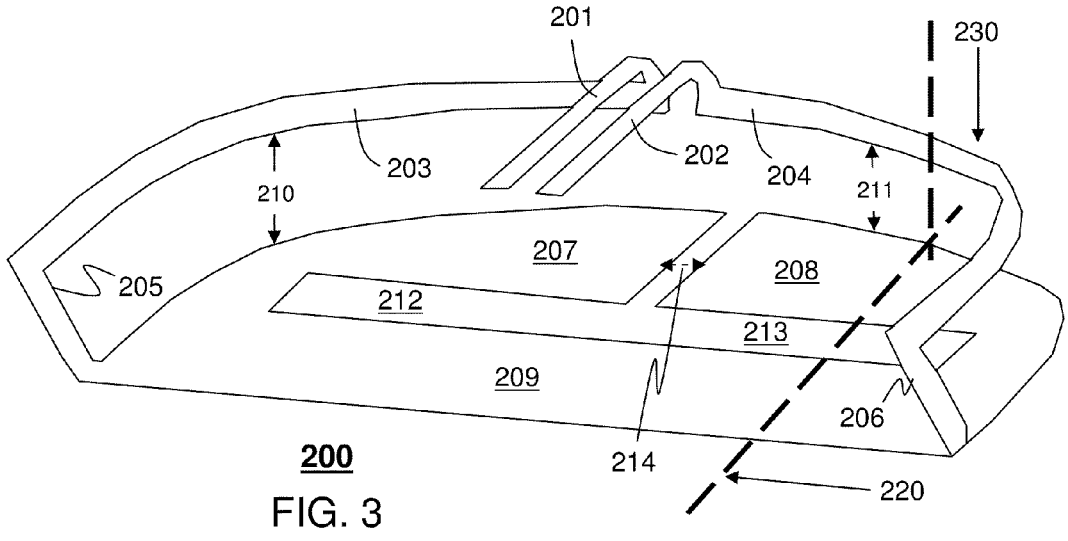
FIG. 3 depicts a bottom perspective view of the antenna of FIG. 2.

FIG. 2 depicts a top perspective view of a conformed slotted folded dipole antenna 200 and FIG. 3 depicts a bottom perspective view of the same antenna 200. The antenna 200 can include a feeding end or feed 201 (hot launch) and a grounded end 202 (cold launch) which can be reversed. Low band resonance can be created by elements 203, 205, 204, 206, and 209. This combination of elements forms a folded dipole where the tuning for this low band can be realized by tuning or trimming element 209 which can be a longer straight line or meandering if space is limited.

Resonances in other bands (such as high bands) can be created from slots created from elements 207 and 208 along with elements 203, 205, 204, and 206 which in combination forms slots 210, 211 and 214. Tuning these bands can be carried out easily by simply cutting (or adding) conductive portions or metal pieces from (or to) elements 207 and 208 (i.e., change the length of slots A and B). Slots A and B should be symmetric for easy band-tuning. But asymmetric slot tuning can also be applied, depending on the bands required.

Tuning low band and high bands are primarily or totally independent because low band tuning relies on the total length of the elements but high band tuning relies on the slots A and B. During each tuning, the common elements 203, 205, 204, and 206 do not need to change, which, combined with the slot concept, facilitates creation of other bands and the ability to tune all the bands easily and independently.

In the embodiments herein, during the tuning of high bands, the change of slots 212 and 213 has little effect on low band resonance with respect to antenna element 209. This is an additional verification that high bands are mainly created by slots A (210) and B (211).

The separation of the gaps of slots A and B can be used to tune its resonance as well. The wider the gaps (210, 211, and/or 214), the higher the frequency moves to. It is found that this tuning method for high bands only brings a very little (or insignificant) effect on low band resonance because elements 205 and 206 are changed but they are very small segments compared to the total length of the folded dipole antenna for low band resonance. Plots for different slot tunings in the design of antenna 200 can illustrate that resonance in high bands moves drastically with tuning but the low bands (such as the 850 and 900 MHz bands) see a very small change.

As noted above, one embodiment can entail a multiband comformed-slotted-folded dipole antenna having a unitary conformed shape conductor (200) conforming to an internal communication device configuration (see 400 of FIG. 4), a folded dipole (203, 205, 209, 204, and 206) forming a part of the unitary conformed shape and having a first portion (212, 213 and/or 214) forming at least one slot in a slotted plane 220 and a second portion (210 or 211) forming at least one slot in a second plane 230 substantially perpendicular or orthogonal to the slotted plane 220. The antenna can have at least one slot in the second plane that controls high band antenna resonance and a length of a metal portion 209 in the slotted plane 220 that controls lower band resonance.

Another embodiment can more particularly include a first slot A or 210 and a second slot B or 211 in the second plane 230 that controls a high band resonance when the slots are tuned, and a conductive line 209 in the slotted plane having a length that controls a low band resonance.

Yet another embodiment of the present disclosure can entail an antenna 200 having a substantially T-shaped slot (form by slots 212, 213, and 214) in a slotted plane 220 forming a low band controlling line portion 209 coplanar and above the T-shaped slot and a high band controlling line portion (207 and/or 208) coplanar and below a cross bar of the T-shaped slot, and a conductive line (203 and/or 204) that is non-coplanar with the slotted plane 220 and forms a slot having a gap (210 and/or 211) between the slotted plane 220 and the conductive line 203, 204 where the gap further controls a high band resonance of the antenna.

Figure 4:
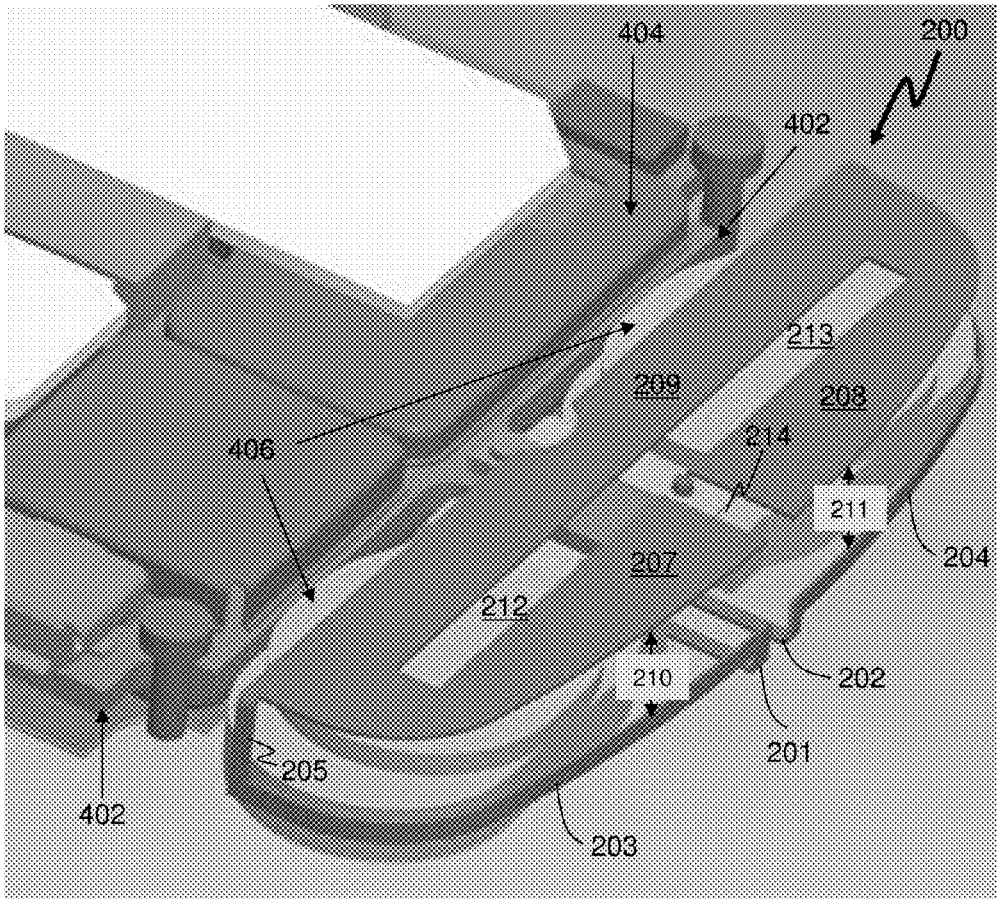
FIG. 4 depicts a top perspective view of the internal portion of a communication device including the antenna of FIG. 2 in accordance with an embodiment of the present disclosure.

Besides the easier multi-band resonance creation and tuning, the embodiments herein can conform to the various shapes or components that might be found in today's diverse communication devices. For example, as illustrated in FIG. 4, the antenna 200 can conform to the top of an audio transducer or speaker 406 for a communication device 400. In one particular embodiment, the antenna 200 can be placed only 2.5 mm away from the magnetic and metal parts of the speakers 406 and hence advantageously use the volume in the phone. The design also relaxes the "keep-out" distances that the antenna must have from a PCB grounded plane. Communication device 400 can include a printed circuit board (PCB) 404 that has a grounded plane that can include shields 404. In a FJA design, the antenna should be at least 13 mm away from the ground plane, but a design in accordance with the embodiments herein can have the antenna just 4.5 mm away from the PCB ground plane.

Note that the antenna 200 can also provide a wide resonance at low band. Obtaining such a wide resonance at low bands can be particularly difficult for flip phone configurations, but the embodiments herein are suitable for flip phones and monolith shaped devices where the wide resonance can be moved to a desired low band based on a given length of a phone for example. Further note that since the antenna's volume can be large, the bandwidth of antenna will improve. Also, as in FICA and FDA designs, the grounded end of the CSFD antenna helps reduce the adverse effect from proximity to human body parts (torso, head, hand) and thus it can provide for good performance in real use cases.

The foregoing embodiments of the antennas illustrated herein provide a multiband antenna design with a wide operating bandwidth where desired. Application of this design can be for any wireless devices, not necessarily limited to mobile devices.

The specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The embodiments herein are defined solely by the appended claims including any amendments made during the pendency of this application and all equivalents of those claims as issued.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A multiband comformed-slotted-folded dipole antenna, comprising:

a unitary conformed shape conductor conforming to an internal communication device configuration;

a folded dipole forming a part of the unitary conformed shape and having a first portion forming at least one slot in a slotted plane and a second portion forming at least one slot in a second plane substantially perpendicular to the slotted plane; and wherein the at least one slot in the second plane controls high band antenna resonance and a length of a metal portion in the slotted plane controls lower band resonance.

2. The antenna of claim 1, wherein the length of the slot in the second plane controls the high band resonance.

3. The antenna of claim 1, wherein a gap separation between a plurality of slots in the second plane controls the high band resonance.

4. The antenna of claim 1, wherein the length of the slot in the second plane and a gap separation between a plurality of slots in the second plane controls the high band resonance.

5. The antenna of claim 1, wherein the antenna is designed for resonating in bands among 800 MHz, 900 MHz, GPS, 1800 MHz, 1900 MHz, 2.4 GHz, and 2.5 GHz.

6. The antenna of claim 1, wherein the tuning of the slot in the second plane minimally impacts the low band resonance.

7. The antenna of claim 1, wherein the tuning of a length of metal in the slotted plane minimally impacts high band resonances.

8. The antenna of claim 1, wherein the antenna further includes a feeding end and a grounded end, wherein such arrangement is substantially insensitive to nearness to a human body.

9. The antenna of claim 1, wherein the antenna comprises two slots in the second plane that are symmetrical for tuning.

10. The antenna of claim 1, wherein the low band tuning and the high band tuning is completely independent.

11. The antenna of claim 1, wherein the antenna conforms around an audio transducer element in the communication device.

12. The antenna of claim 1, wherein the metal portion in the slotted plane is a meandering line.

13. An antenna, comprising:

a conformed slotted dipole antenna element having first antenna elements in a slotted plane and second antenna elements in a second plane, wherein the slotted plane is substantially orthogonal to the second plane;

a first slot and a second slot in the second plane that controls a high band resonance when the slots are tuned; and a conductive line in the slotted plane having a length that controls a low band resonance.

14. The antenna of claim 13, wherein a trimming of a length of the slot in the second plane controls the high band resonance in the frequency range of 2.4 GHz and 2.5 GHz.

15. The antenna of claim 13, wherein a horizontal gap separation between the first slot and the second in the second plane at least partially controls the high band resonance.

16. The antenna of claim 13, wherein a vertical gap separation between the slotted plane and the conductive line at least partially controls the high band resonance.

17. The antenna of claim 13, wherein the tuning of the first and second slot in the second plane minimally impacts the low band resonance and the tuning of a length of the conductive line in the slotted plane minimally impacts high band resonances.

18. The antenna of claim 13, wherein the antenna conforms around an audio transducer element in a communication device.

19. An antenna, comprising:

a substantially T-shaped slot in a slotted plane forming a low band controlling line portion coplanar and above the T-shaped slot and a high band controlling line portion coplanar and below a cross bar of the T-shaped slot;

a conductive line that is non-coplanar with the slotted plane and forms a slot having a gap between the slotted plane and the conductive line, wherein the gap further controls a high band resonance of the antenna.

20. The antenna of claim 19, wherein the antenna conforms around the shape of an audio transducer in a mobile communication device.

* * * * *